US006216681B1

(12) United States Patent
Dougherty et al.

(10) Patent No.: US 6,216,681 B1
(45) Date of Patent: Apr. 17, 2001

(54) METHOD AND APPARATUS FOR HORIZONTAL CASTING OF AN ARCHERY BOW

(76) Inventors: Patrick J. Dougherty, 13891 Marihugh Rd., Mount Vernon, WA (US) 98273; Matthew T. Mussivand, 7726 Tohomly Rd., Stanwood, WA (US) 98292

( * ) Notice: Subject to any disclaimer, the term of this patent is extended or adjusted under 35 U.S.C. 154(b) by 0 days.

(21) Appl. No.: 09/638,450

(22) Filed: Aug. 14, 2000

Related U.S. Application Data

(60) Provisional application No. 60/148,471, filed on Aug. 12, 1999.

(51) Int. Cl.[7] ..... F41B 5/00
(52) U.S. Cl. ..... 124/88
(58) Field of Search ..... 124/23.1, 88, 25

(56) References Cited

U.S. PATENT DOCUMENTS 3,566,853 3/1971 Larm .
4,603,676 * 8/1986 Luoma ..... 124/25
4,787,361 * 11/1988 Vyprachticky ..... 124/88
4,957,093 9/1990 Hamlett .
4,976,250 * 12/1990 Jeffrey ..... 124/25
4,996,968 * 3/1991 Hollingsworth ..... 124/88 X
5,092,308 3/1992 Sheffield .
5,119,796 * 6/1992 Dehlbom ..... 124/23.1

* cited by examiner

*Primary Examiner*—John A. Ricci
(74) *Attorney, Agent, or Firm*—Todd N. Hathaway

(57) ABSTRACT

An apparatus and method for casting a hand bow in a horizontal orientation, to provide reduced forearm slap, increased accuracy, and reduced grip arm fatigue. The horizontal orientation also enables the bow assembly to be used in seated and prone positions, as well as when standing. A grip member having a rearwardly facing alignment channel is mounted or formed on the riser of the bow. The channel is configured to receive and engage the metacarpal head area or another portion of the grip hand so as to form a horizontal pivot axis. The pivot axis is positioned in substantially the same plane as the primary plane of the bow assembly, thereby minimizing development of torque when the bowstring is drawn. A bracket assembly is provided for mounting an arrow rest and sights for use in the horizontal orientation.

21 Claims, 5 Drawing Sheets

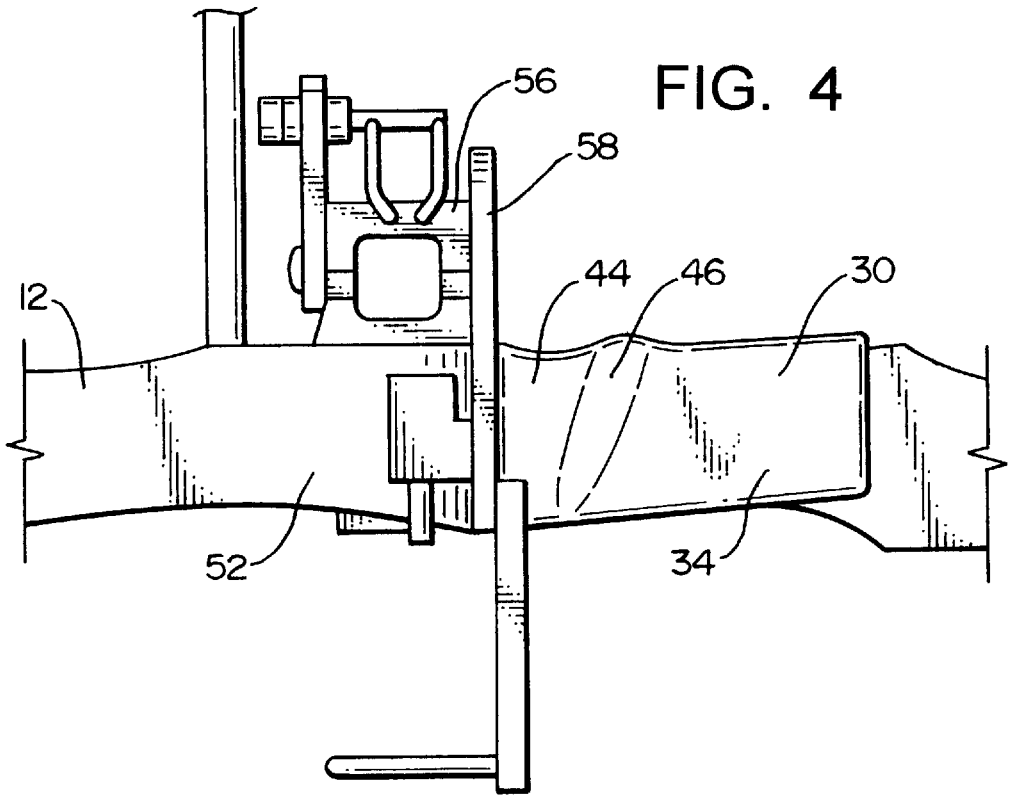
FIG. 4
FIG. 5
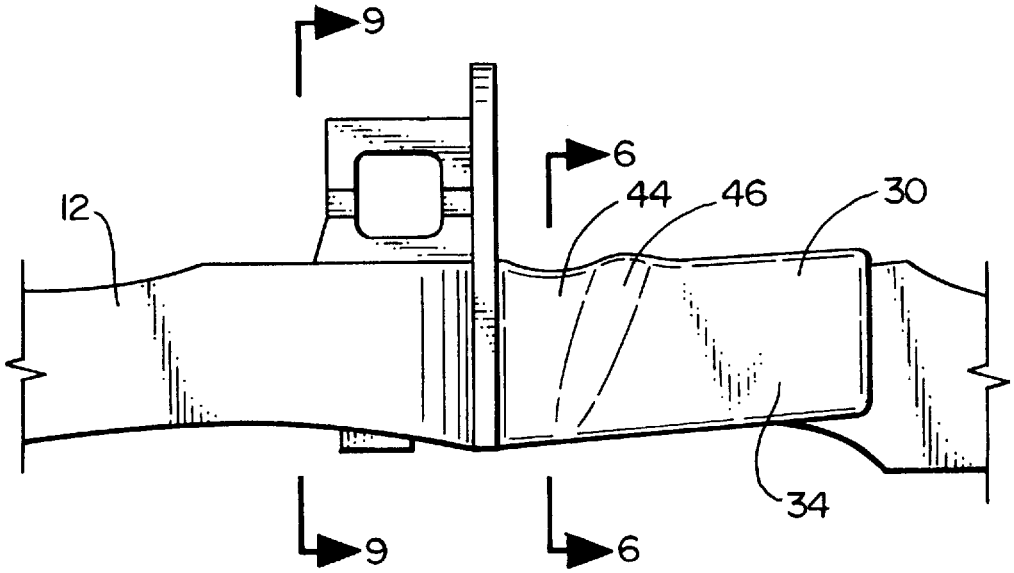

METHOD AND APPARATUS FOR HORIZONTAL CASTING OF AN ARCHERY BOW

This application claims the priority of U.S. provisional patent application Ser. No. 60/148,471, filed Aug. 12, 1999.

BACKGROUND a. Field of the Invention

The present invention relates generally to archery bows, and more particularly, to a method and apparatus for casting an archery hand bow in a horizontal orientation, as opposed to the conventional vertical orientation.

b. Related Art

The historical relationship between the stringed stick and mankind is well documented. The discovery of the "Ice Man", frozen in time in the Italian-Austrian Alps with his cedar shafts and yew wood hand bow, accentuates the role that the bow and arrow has played in the colonization of our planet earth. Time has honored the hand bow with relatively few changes in the design and in the techniques that are used to practice the art.

The basic hand bow was formed of an elongated section of wood fashioned with a central handgrip, was tensioned end-to-end by a length of sinew or other string-like material. Modifications in the curvature and length of the riser and limbs have occurred over time and have given rise to more highly developed forms. These bows are generally referred to as "long bows" and "recurve bows".

More recent developments have employed cables, pulleys and eccentric wheels, in combination with composite materials, to enhance the power, speed, draw-weight, holding and shooting properties of bows, while reducing the overall dimensions of the assemblies. This has led to the creation of a new style of archery bow, termed, the "compound bow."

Yet another type of bow that has been developed is the "crossbow," which typically employs a compound type bow mounted to a firearm style butt/stock section. The butt/stock section includes a locking trigger mechanism for the purpose of mechanically holding the draw-weight of the bowstring at full draw, independent of the archer, until the triggering mechanism is operated. Crossbows are therefore "cock-and-shoot" devices that differ greatly from hand bows in which the drawn string is held by the archer's hand. While the present invention may be useful with respect to crossbows in some embodiments, it is directed primarily to use with hand bows and so the following description will focus primarily on the latter.

When using a hand bow, conventional methods call for casting the bow in a vertical or near vertical orientation. This follows time-honored practice, but is the source of several problems. For example, when vertically casting a hand bow, considerable forearm slap is exerted by the bowstring against the archer's grip arm. Not only is forearm slap painful to the archer, but it exerts detrimental torque and transfers destabilizing forces to the arrow, thus adversely effecting the accuracy and the speed of the arrow. Attempts to reduce forearm slap by moving the handgrip off centerline from the plane of the bow riser and limbs (e.g., by modifying the riser so that the grip is off-set to one side of the plane) result in the development of detrimental side torque forces during operation. Thus, in the absence of a satisfactory solution, archers are commonly forced to wear forearm protectors in order to reduce the effects of forearm slap and interference.

Additional disadvantages shared by conventional, vertically-cast hand bows include the following:

(a) There is considerable difficulty operating a hand bow while seated or lying down, and in high and low trajectories, due to bow length and limb interference with surrounding obstacles, such as the archer's body, the ground, a tree stand, tree branches, and so on.

(b) The target must be acquired off-hand, due to the fact that the protruding limbs of a vertically held bow prohibit the use of a stabilizing rest to assist in steadying the bow for target acquisition and accuracy.

(c) The vertical alignment of the wrist causes the forearm to rotate 90 degrees relative to the shoulder, increasing the tendency of the arm to bend at the elbow when the bow is drawn, and also increasing upper arm fatigue in use. This has the effect of reducing the maximum draw weight of a bow that can be used by an individual archer and/or the duration for which it can be used by the archer without having to rest. Furthermore, accuracy tends to deteriorate rapidly with increased fatigue of the grip arm, since the entire grip arm must be raised and lowered in fine increments in order to adjust the aim.

(d) Accuracy further suffers because the vertically held handgrip rests against the soft, fleshly crotch of the hand, between the thumb and forefinger. The natural flexibility and "give" of the muscles and tendons in this area allow the bow to move or wobble slightly when drawn. Also, accuracy again tends to decrease with fatigue, as the muscles of the hand become tired and relax, tending to further soften the tissues against which the bow rests.

(e) The archer's field of view is greatly reduced by the obstructions caused by the vertical bow riser and the accessories that are attached to the riser, such as the arrow rest, sight mount, and arrow quiver, all of which are generally mounted along the plane of the riser.

A number of prior attempts have been made at addressing one or more of the above problems, however, none has been successful in achieving more than a partial solution. For example, several types of "pistol grip" or "wrist rocket" type bows have been proposed, such as those disclosed in U.S. Pat. No. 4,957,093 (Hamlett) and U.S. Pat. No. 3,566,853 (Larm). Both of these references show bows that employ a pistol grip mounted perpendicular to and below the plane of the bow riser and limbs. Although such grip positioning reduces the problem of a forearm slap and presents the bow in a generally horizontal orientation, the offset position of the grip causes this to transmit excessive side torque to the riser and limbs of the bow, to the extent that forearm protectors and pivoting grip interfaces are resorted to in an attempt to minimize and counteract this effect.

U.S. Pat. No. 4,996,968 (Hollingsworth) and U.S. Pat. No. 5,092,308 (Sheffield), in turn, describe bows having horizontal bow grips, positioned parallel to and below the plane of the riser and limbs. Like the pistol grip devices described above, this arrangement suffers from the development of extreme side torque loads, again causing de-stabilizing forces and forcing the use of forearm protectors and compensation structures. For example, the Sheffield bow employs a bowstring alignment shaft to assist in compensating for side torque during drawing of the bowstring; as soon as this string is released, however, the torque becomes unbalanced and adversely influences the launch of the arrow.

A great many other variations on bows, grips and handles are known in the art, including those shown in the following references: U.S. Pat. No. 4,766,874 (Mishioka), U.S. Pat. No. 5,333,595 (Hefforn), U.S. Pat. No. 5,853,000 (Torgerson), U.S. Pat. No. 4,124,014 (Darlington), U.S. Pat. No. 5,853,001 (Vyprachtichy), U.S. Pat. No. 4,787,361 (Vyprachtichy), U.S. Pat. No. 4,343,286 (Thacker), U.S. Pat. No. 5,119,796 (Dehlbom), U.S. Pat. No. 4,889,102 (Martin), U.S. Pat. No. 5,555,875 (Martin), U.S. Pat. No. 4,457,287 (Beddington), U.S. Pat. No. 3,599,621 (Scrobell), U.S. Pat. No. 3,834,368 (Geiger), U.S. Pat. No. 4,258,689 (Barnett), U.S. Pat. No. 4,252,100 (Rickard), U.S. Pat. No. 5,335,645 (Simonds), U.S. Pat. No. 5,260,284 (Pujos, et al) and U.S. Pat. No. 5,243,959 (Savage). All of these, however, suffer from the disadvantages of vertical bows and bows with offset/off center-line grips, as been described above.

Accordingly, there exists a need for an apparatus and method for gripping an archery hand bow that eliminates the forearm slap which is caused by the bowstring. Furthermore, there exists a need for such an apparatus and method in which the wrist is aligned in a horizontal orientation so as to obtain maximum benefit of the musculo-skeletal structure of the grip arm. Still further, there exists a need for such an apparatus and method that will place the bow in engagement with a firm, stable portion of the grip arm/hand so as to achieve maximum stabilization of the bow when drawn. Still further, there exists a need for such an apparatus and method which enables a hand bow to be operated from standing, seated and prone positions. Still further, there exists a need for such an apparatus and method which allows a stabilizing rest to be used to assist the archer in target acquisition and shot accuracy. Still further, there exists a need for such an apparatus and method which will minimize visual obstructions and will present the archer with improved field of view. Still further, there exists such a need for such an apparatus and method which will provide the archer with protection from being injured by a hunting broad-head as this is released and shot from the bow.

SUMMARY OF THE INVENTION

The present invention has solved the problems cited above, and is a bow assembly for being cast in a horizontal orientation. Broadly, the bow assembly comprises a bow body having a riser, limbs and bowstring that define the primary plane of the assembly, and a grip member on the riser of the bow body, the grip member comprising a horizontally extending alignment channel for engaging a portion of a user's grip hand so as to define a generally horizontal pivot axis between the grip member and the hand, the channel being positioned so that the pivot axis is formed proximate and substantially parallel to the primary plane of the bow assembly, so as to minimize development of torque about the pivot axis as the bowstring is moved rearwardly towards the drawn position.

The alignment channel in the grip member may comprise a generally concave channel portion for receiving and engaging a ball portion of the user's grip hand. The generally concave channel portion may comprise a horizontally elongate, generally concave channel portion for receiving a metacarpal head portion of the user's grip hand at the base of a plurality of fingers of the hand.

The horizontally extending alignment channel may be located proximate the rearward edge of the riser. The grip member may further comprise a rearward surface having the alignment channel formed therein, an upper surface contoured for engaging the fingers of the user's grip hand, and a lower surface contoured for engaging the thumb of the user's hand. The assembly may further comprise a thumb rest which extends downwardly below the grip member for engaging the thumb of the user's grip hand so as to stabilize the bow assembly as the bowstring is moved rearwardly towards its drawn position.

The grip member may be formed as a separate piece that is mounted to the riser, or it may be formed integrally with the riser.

The bow assembly may further comprise means for supporting an arrow rest in a horizontal orientation parallel to the primary claim of the assembly. The means for supporting the arrow rest may comprise a bracket assembly mounted to the riser, the bracket assembly having a rearwardly extending attachment portion with the arrow rest mounted thereto. The bracket assembly may further comprise an upwardly extending attachment portion having at least one sighting aid mounted thereto in a horizontal orientation above and parallel to the primary claim of the assembly. The bracket assembly may further comprise a thumb rest portion which extends downwardly from the riser for engaging a thumb of the user's grip hand.

The invention also provides an apparatus for mounting to a bow body so as to form a bow assembly for being cast in a horizontal orientation, the bow body having a riser, limbs and bowstring that define a primary plane of the assembly, the apparatus comprising a grip member which is mountable on the riser of the bow body, the grip member comprising a horizontally extending alignment channel for engaging a portion of a user's grip hand so as to define a generally horizontal pivot axis between the grip member and the hand, the alignment channel being positioned so that when the grip member is mounted on the riser the pivot axis is formed proximate and substantially parallel to the primary plane of the bow assembly, so as to minimize development of torque about the horizontal pivot axis as the bow string is moved rearwardly towards the drawn position.

The invention further provides a method for casting a bow assembly in a generally horizontal orientation, the bow assembly including a bow body having a riser, limbs and bowstring that define a primary plane of the assembly, the method comprising the steps of providing a grip member on the riser, the grip member having a horizontally extending channel portion formed therein, and engaging the horizontally extending channel portion with the portion of the user's grip hand so as to define a generally horizontal pivot axis between a grip member and a hand, the alignment channel being positioned so that the pivot axis is formed proximate and substantially parallel to the primary plane of the bow assembly, so as to minimize development of torque about the horizontal pivot axis as the bowstring is moved rearwardly towards a drawn position.

The step of engaging the horizontally extending channel portion of the user's grip hand may comprise engaging a generally concave portion of the channel portion with the ball portion of the user's grip hand.

The method may further comprise the steps of moving the bowstring rearwardly to a drawn position with an arrow in nock position on the bow assembly, and pivoting the bow assembly about the horizontal axis which is defined by the grip member and the ball portion of the grip hand so as to aim the arrow in the nock position, by moving the bow string alternately in upward and downward directions with the bowstring in the drawn position.

These and other features and advantages of the invention will be apparent from reading of the following detailed description with reference to the associated figures.

BRIEF DESCRIPTION OF THE DRAWINGS

FIG. 4 is a partial, top plan view of the riser portion of the bow assembly of FIGS. 1–3, with the front of the riser being towards the bottom in FIG. 4, showing the relationship of the grip member to the arrow rest and sights that are mounted on an angled bracket assembly for horizontal use assembly;

FIG. 5 is a partial, plan view, similar to FIG. 4, but with the arrow rest and sights removed to show the grip member and bracket assembly in greater detail;

DETAILED DESCRIPTION a. Overview

The present invention provides a method and apparatus in which a hand bow is cast in a horizontal orientation, with the wrist being held horizontal and the grip established in substantially the same plane as that of the riser and limbs. The fingers of the grip hand are held open, with a portion of the hand resting in engagement with the rearward face of the grip member. In a preferred embodiment, the grip member includes a contoured channel for engaging the metacarpal head portion of the hand in a stable interfit therewith. The channel is located along the rearward edge of the riser so as to be in the same place as the riser. Since the grip is thus formed in the same plane as the primary plane of the bow assembly, development of undesirable torque due to the bowstring being drawn is greatly reduced or eliminated.

Moreover, when held in this manner, the bow is supported by the relatively firm area at the ends of the metacarpal bones, rather than being held in the relatively fleshy, flexible crotch of the hand as in prior art configurations. Also, the bones of the arm and shoulder are loaded efficiently in compression, so that there is less tendency for the elbow to bend, thus making it easier for the archer to hold the bowstring in a drawn position for an extended period of time. Still further, as will be described in greater detail below, this arrangement enables the assembly to be very easily and precisely aimed, by simply pivoting or rocking the horizontally held bow against the metacarpal ridge of the hand.

When held in this manner, the bowstring clears the forearm when released, thus eliminating the forearm slap and related problems described above. The horizontal orientation of the bow also removes most of the obstructions from the shooter's field of view, and the bow may be raised and lowered without being constrained by the length of the limbs. Furthermore, this orientation makes it possible for a hand bow to be operated with the archer in prone and seated (for example, seated in a wheel chair) positions, as well as when standing. Similarly, this orientation enables the archer to use a stabilizing rest (e.g., a tripod or stump) when acquiring the target and aiming.

c. Structure

The grip member of the present invention may be formed as a integral part of the riser section of a bow assembly, or as a separate piece which is mountable to an otherwise conventional riser so as to convert an existing hand bow to horizontal use; for purposes of illustration, this latter embodiment will be described in detail below.

Figure 1:
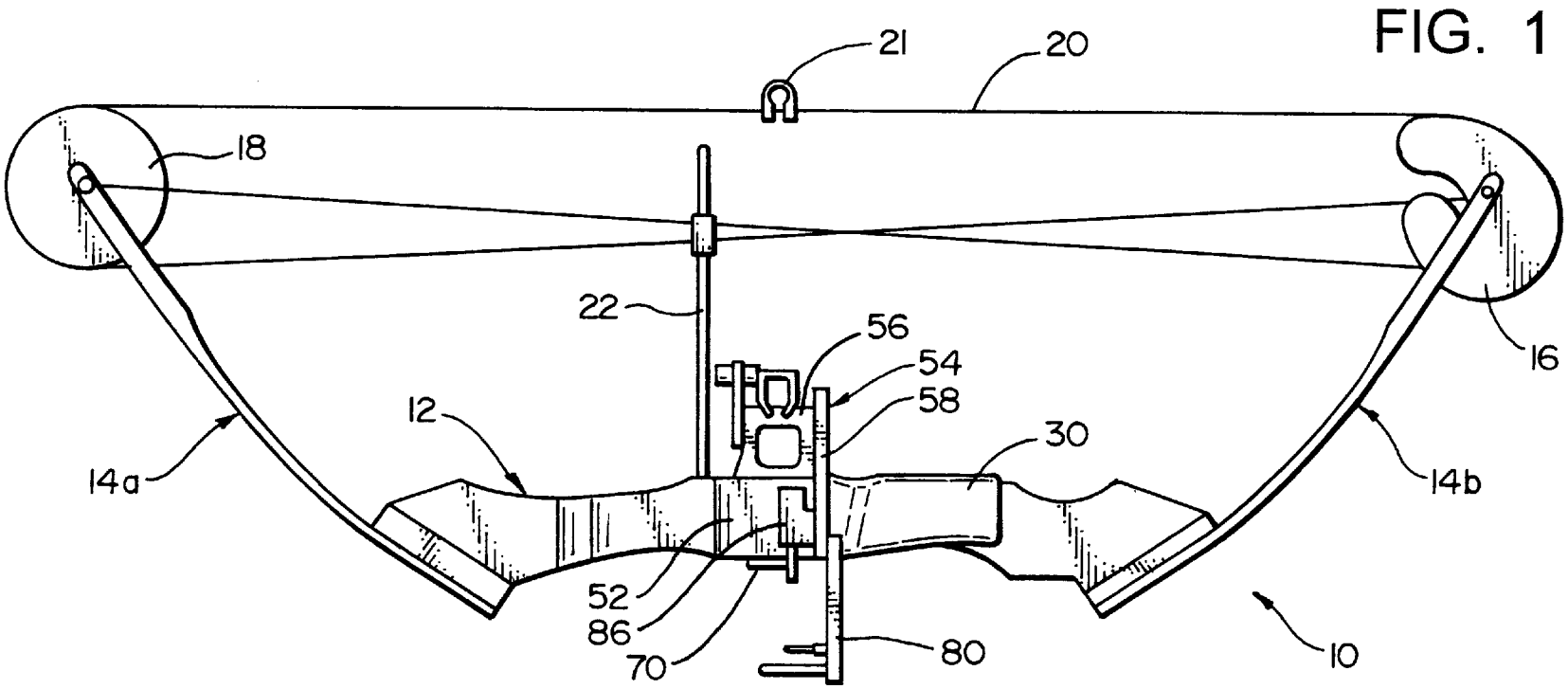
FIG. 1 is a top, plan view of a compound bow assembly in accordance with the present invention, showing the manner in which a horizontal grip member for receiving and engaging the archer's grip hand is mounted on the bow riser to the side of the arrow rest and sight assembly.

Accordingly, FIG. 1 shows a hand bow assembly 10 which includes a generally conventional riser section 12 having first and second limbs 14*a*, 14*b* mounted to its outer ends. The riser 12 is shown as a separate piece to which the two limbs are attached, which is the typical construction in modern bows; it will be understood, however, that in some instances the riser, as this term is used in this description and the appended claims, will be formed integrally with the limbs or may simply be a central portion of one continuous "limb" or stick. Also in a conventional fashion, a cam wheel 16 and pulley 18 are mounted to the outer ends of the limbs and support the bowstring 20; the bowstring may be suitably formed from a conventional multi-strand loop, and may include a metal tab 21 for engaging the rearward end of the arrow when in the nock position. A cable guard 22 is attached the forward legs of the cables, with the forward end of the support for the guard being mounted to the riser section 12.

The components thus far described may be provided in the form of a conventional compound bow, such as a model MQ32 compound bow available from Matthews Archery, Inc. of Sparta, Wis., USA. However, it will be understood that the components may be of any suitable manufacture and may be formed of any materials suitable for use in archery and in compound archery bows, such as wood, aluminum, graphite, fiberglass, laminated fiber-resin materials, and composite materials, for example.

With further reference to FIG. 1, it can be seen that the grip member 30 of the present invention is mounted to the riser section 12 in a location somewhat to one side of the middle of the riser, but still in a common plane with the riser. In the embodiment which is illustrated, the grip member is mounted on the left side of the riser section for use by the grip hand of a right-handed person, however, it will be understood that a "mirror image" grip member may be mounted towards the right side of the riser for use by a left-handed person, or grip members may be provided on both sides if desired.

Figure 6:
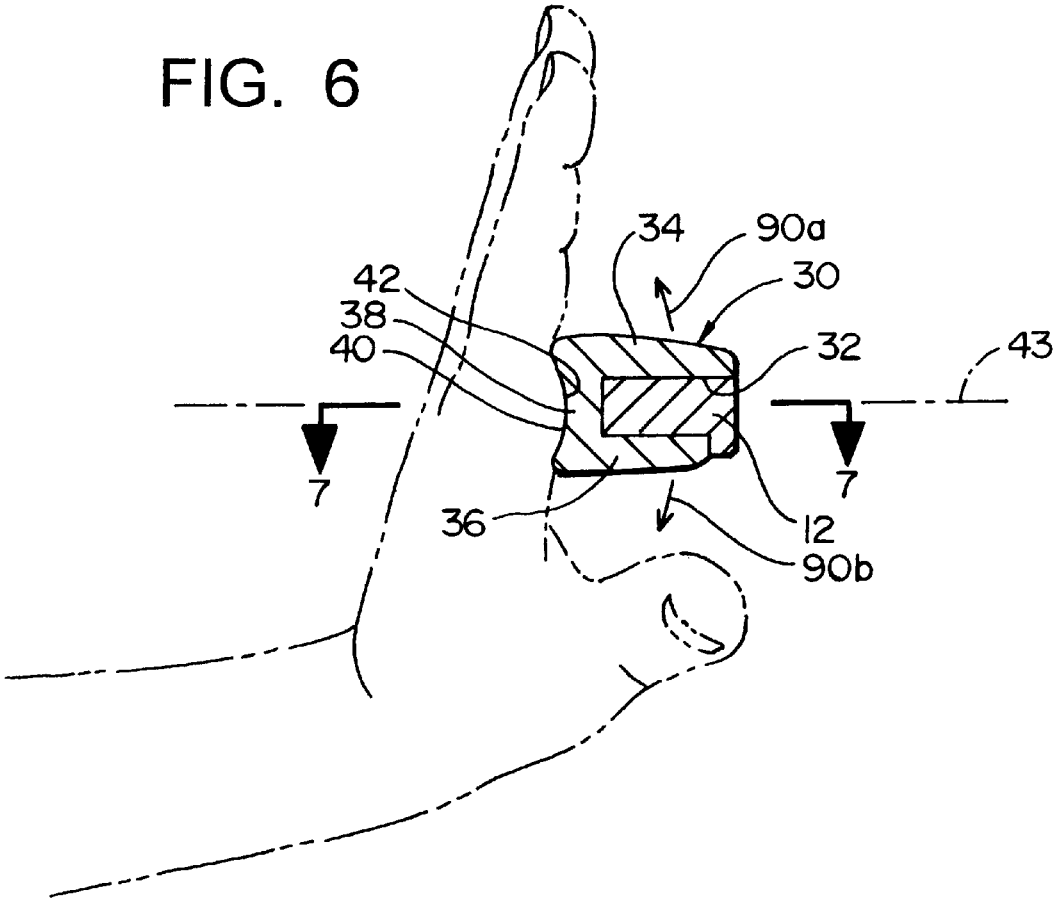
FIG. 6 is an end, cross-sectional view of the grip member of the bow assembly of FIGS. 1–5, taken along line 6—6 in FIG. 5, showing the manner in which the ball of the user's hand engages the channel in the grip member when the hand is held in position for aiming and release of the assembly.

As can be seen in FIG. 4 and also in FIG. 6, the grip member in this embodiment is a somewhat rectangular member having a U-shaped cross-section. A slot 32 is formed along the forward edge of the grip member, between upper and lower flange portions 34, 36 and is configured for receiving the rearward edge of the riser section 12 in close-fitting engagement therewith. In this way, the grip member may be permanently or temporarily affixed to the riser section, as by an adhesive, fasteners or in any other suitable manner. It will be understood that in some embodiments, however, the upper and lower web portions may be abbreviated or even dispensed with, with only the rearward surface of the member being present; alternatively, in other embodiments, the grip member may be formed by affixing side plates to the riser so that these extend rearwardly in a spaced apart manner so as to define the channel area.

As can be seen with further reference to FIG. 6, the vertically extending rearward web 38 of the grip member includes an alignment channel 40 formed in its rearward surface. The alignment channel is generally concave and is contoured to correspond to the metacarpal head area 42 of the user's hand; as a result, the channel is preferably deepest in the area at the metacarpal head of the index finger (thereby forming the generally concave depression or socket 40 shown in FIG. 7), and is somewhat shallower for the metacarpal heads of the other fingers. The alignment channel is preferably configured to receive the metacarpal head area all across the palm as is shown, however, in some embodiments the channel may be formed to engage the metacarpal heads of less than all the fingers, such as only those of the index and middle fingers, for example.

With further reference to FIG. 6, it will be observed that the metacarpal channel 40 lies directly behind and in the plane of the riser 12, which in turn corresponds to the main plane 43 defined by the limbs and bowstring of the assembly. Consequently, when the metacarpal ridge of the hand engages the channel this forms a pivot axis between the two which extends in a generally horizontal direction. Since this axis lies substantially on the main plane of the bow assembly, this reduces or eliminates the undesirable side-torque forces that are generated in devices where the grip is offset from the plane of the assembly, as has been described above.

Figure 8:
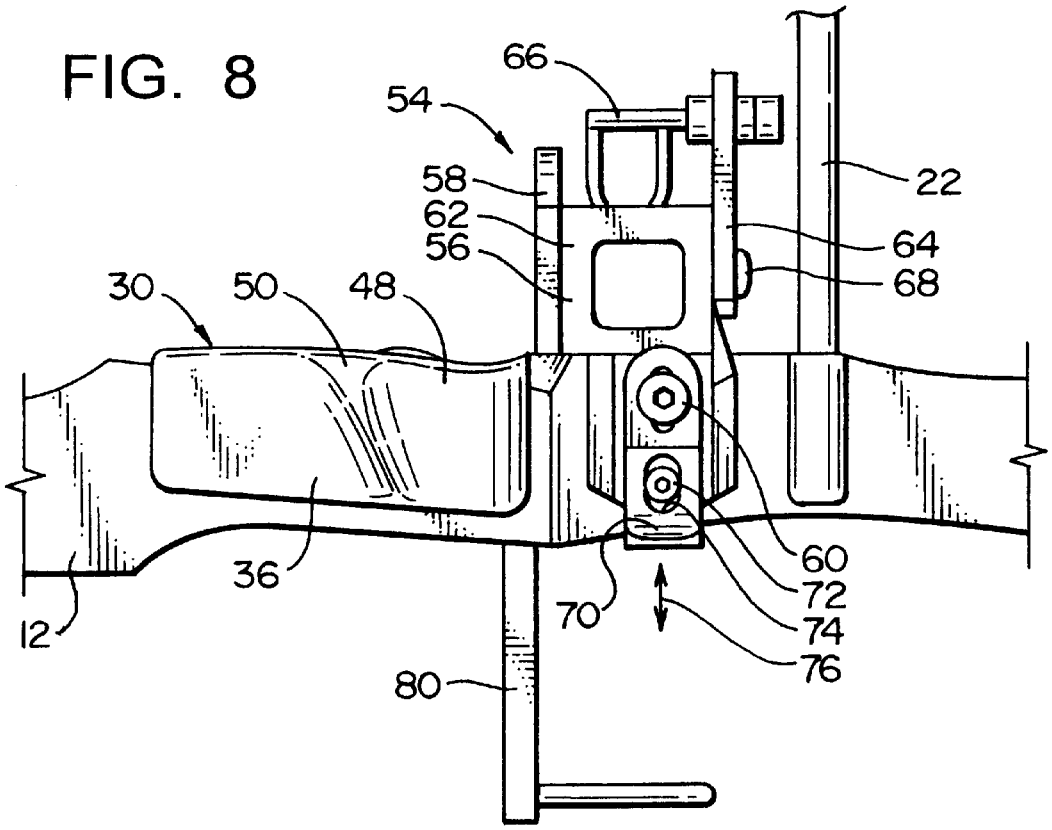
FIG. 8 is a partial, bottom plan view of the grip member and riser section of the bow assembly of FIGS. 1–5, with the front of the riser being towards the bottom in FIG. 8, showing the underside of the grip member and the thumb rest on the bracket assembly in greater detail.

As can be seen in FIGS. 4 and 8, the upper flange 34 of the grip member is also preferably provided with a channel 44 and ridge 46 for receiving the index finger itself, and may be contoured for the remaining fingers as well, and the lower web portion 38 preferably includes a channel area 48 and ridge 50 for the user's thumb. These features aid the user carrying and initially positioning the hand bow assembly but are not directly related to the primary function of the grip member, which is to bear against the ball of the hand as described above. The channels and ridges on the upper and lower flange portions may therefore be considered somewhat optional, and may not be present in all embodiments.

In the embodiment which is illustrated, the grip member is suitably formed of hardwood, cut to shape on a CNC machine and then smoothed and finished. It will be understood, however, that the grip member may be formed of any suitable material, including various forms of plastics, rubber, metals, laminated fiber-resin materials and composite materials, for example.

For the preferred embodiment which is illustrated in the figures, the grip member 30 may suitably have the following approximate dimensions: length-10 cm, height-2.75 cm, depth-4.5 cm, maximum depth of channel-1.0 cm. The width of the riser slot is sized to match the thickness of the riser itself, e.g., 1.4 cm for use with the riser of the model of bow noted above. These dimensions have been found suitable for use by a male shooter having hands of an average size and shape, dimensions for other sizes and configurations may be within the following approximate ranges:

| | |
|---|---|
| Length | 8 cm–12 cm |
| Height | 1.5 cm–7 cm |
| Depth | 1.5 cm-7 cm |
| Channel length | 8 cm–12 cm |
| Channel width | 0.5 cm–3.5 cm |
| Channel depth | 0.3 cm–1.5 cm |
| Riser slot height | 0.5 cm–6 cm |
| Riser slot depth | 0.5 cm–7 cm |

Referring again to FIG. 1, it can be seen that in addition to the grip member the riser section includes a draw shelf guard 52, and an angled bracket assembly 54 is also mounted to the center part of the riser section to facilitate use of the bow assembly in the horizontal orientation. The bracket assembly includes a horizontal base plate 56 and a vertically extending side plate 58. As can be seen in FIG. 8, the base plate is mounted to the bottom of the center portion of the riser section by a bolt 60 or other suitable means, and includes an attachment portion 62 that projects rearwardly behind the riser. The vertically extending side plate 58 is mounted along one edge of the attachment portion, and an upwardly extending arm 64 bearing the arrow support 66 is mounted to the opposite edge. As can be seen, the arm is mounted to the base plate by a bolt 68 that can be loosened to adjust the height of the support relative to the riser as desired. The base plate also includes a thumb rest 70, which is mounted beneath the forward end of the plate using a bolt 72 and slot 74 that permit longitudinal adjustment, as indicated by arrow 76; the manner in which the thumb rest is used during operation of the bow will described in greater detail below.

Figure 9:
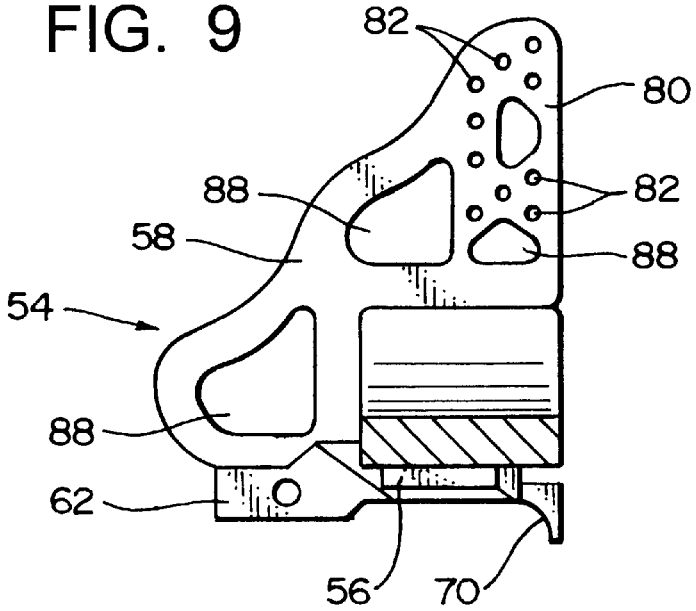
FIG. 9 is an end, cross-sectional view of the bracket assembly of the bow assembly of FIGS. 1–5, taken a long line 9—9 in FIG. 5, showing the thumb rest and the mounting area for the sights and other accessories in greater detail.

As can be seen in FIG. 9, the side plate of the bracket assembly extends upwardly from the base plate and includes an attachment portion 80 having a plurality of mounting holes 82. The mounting holes are configured for attachment of a rear sight and a forward sight rack (containing a plurality of horizontally extending elements that are adjustable for range), as well as any of a number of other sighting aids and accessories. The sighting aids and accessories may be of a conventional after-market type, and the mounting holes 82 are preferably arranged in a pattern that will permit products from different manufacturers to be interchangeably mounted on a single side plate 58 without modification or adjustment. As can be seen in FIG. 9, the side plate also preferably includes a plurality of relief openings 88 so as to minimize its weight.

To reiterate, it will be understood that the description provided above is of an embodiment in which the hand grip and bracket assembly are configured for mounting to a conventional hand bow so as to convert this for casting in a horizontal orientation, and that in other embodiments the grip member and/or bracket assembly may be formed as part of the original bow assembly, and further that the metacarpal channel as described above may be molded or otherwise formed integrally with the riser itself rather than as a separate piece.

d. Operation

The manner of using the archery grip and method of the present invention is simple and straightforward, and those versed in the art will recognize the familiar steps of grip, draw, anchor and release, in the normal routine of traditional archery.

Figure 2:
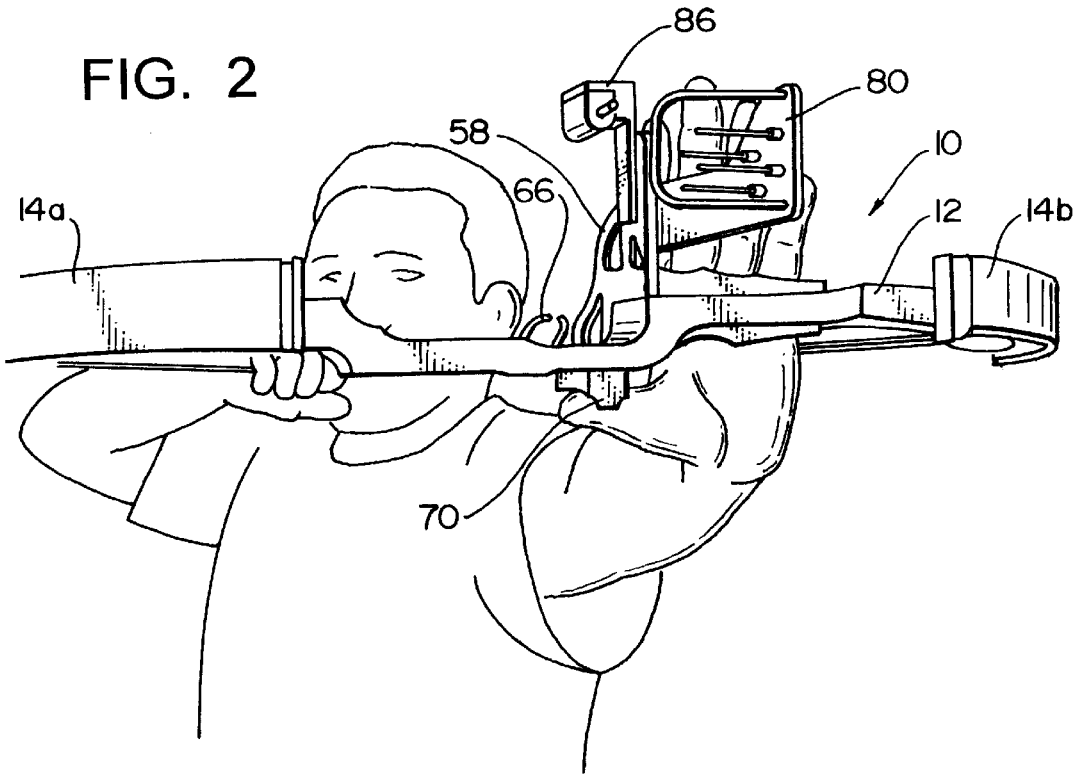
FIG. 2 is a partial, perspective view of the bow assembly of FIG. 1, showing the manner in which the grip member is engaged by the archer's grip hand as the bowstring is drawn.
Figure 7:
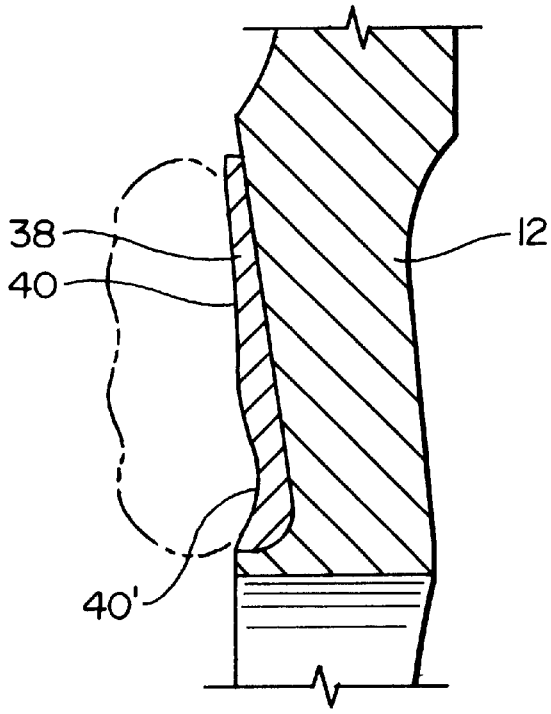
FIG. 7 is a top, cross-sectional view of the grip member of the bow assembly of FIGS. 1–5, taken along line 7—7 in FIG. 6, showing the relationship of the grip member to the hand and bow riser in greater detail.

Thus, in order to use the bow assembly 10 in accordance with the present invention, the operator first grasps the bow from below riser 12 and cable 20 as depicted in FIG. 2. As this is done, the metacarpal channel 40 engages and positions the ball of the grip hand as shown in FIGS. 6–7. The fingers of the hand may be closed about the grip member during the initial steps of lifting the bow and drawing back on the string, with the arrow on the bowstring in nock position. The thumb, however, presses against the thumb rest 70 as shown in FIG. 2, and remains in this position when the fingers are first opened as the bowstring moves towards its drawn position, thereby stabilizing the assembly during initial acquisition of the target.

Figure 3:
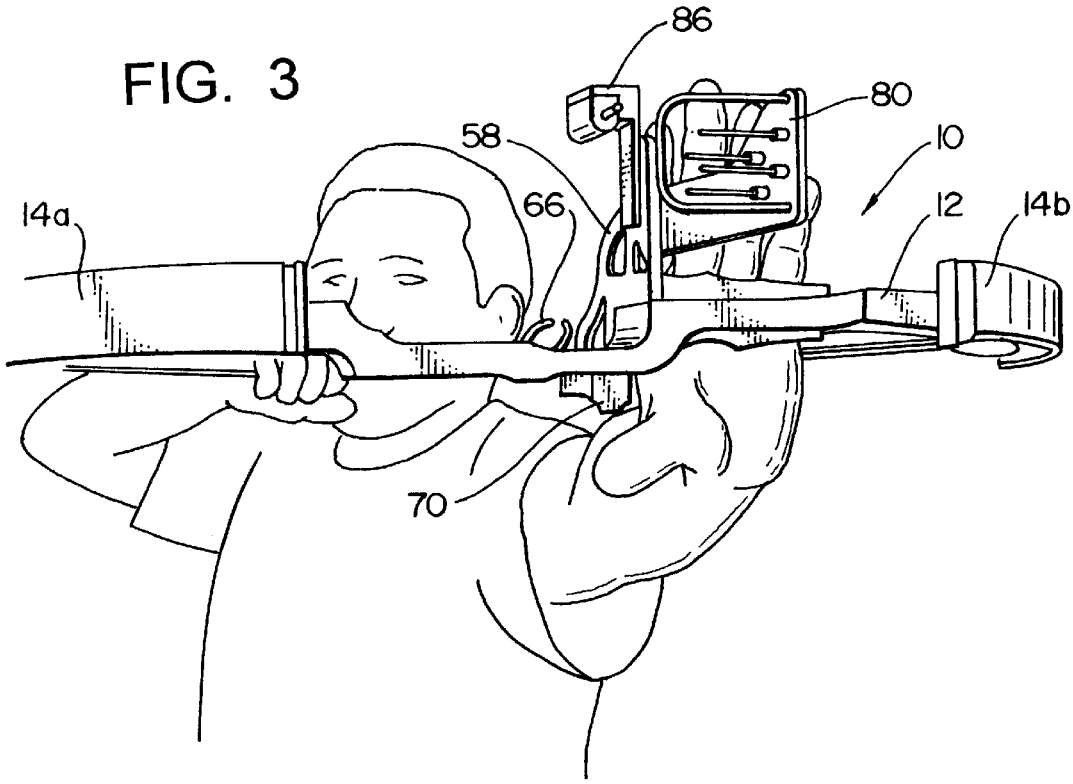
FIG. 3 is a partial, perspective view, similar to FIG. 2, showing the manner in which the thumb of the archer's hand moves off of a thumb rest on the bottom of the assembly in preparation for aiming of the bow and release of the arrow.

A conventional release mechanism (not shown) may be used with the other hand to aid in drawing the bowstring. After the bowstring has reached the fully drawn position, and with the grip arm just short of full lock and slightly bent, the operator drops the thumb of his grip hand off the thumb rest while keeping the remainder of the fingers fully open, as is shown in FIG. 3. This frees the bow assembly to pivot about the in-line axis formed by the channel and the metatarsal ridge of the grip hand, so as to provide smooth, torque free operation of the assembly during release. Furthermore, because this relationship allows for free rotation of the riser at full draw, the operator is able to achieve very fine and precise adjustments in aim by simply raising and lowering the grip hand so as to pivot the bow assembly against the ball of the grip hand, in the direction indicated by arrows 90*a,* 90*b.*

In addition, the horizontal orientation of the wrist and arm makes it easier for the operator to draw the bowstring and hold it at full draw, and if desired, the arm can be temporarily locked in order to transfer loads into the bone structure and thereby rest the muscles of the grip arm. This often needs to be done when waiting for a target animal to move or for other reasons, and the grip arm then can be returned to the slightly bent position for proper final aiming and release. As a result, the present invention makes it possible for a person to use a bow assembly having a higher pull weight than would otherwise be possible.

When the arrow is finally released, the open-handed grip allows for torque free operation of the assembly and stable flight of the arrow. Moreover, because the head of the arrow, which may be a hunting broad-head, is positioned well to one side of the grip hand (rather than being above it as in a conventional bow assembly), and because the vertical plate of the bracket assembly is interposed between the two, the possibility of the arrowhead coming into contact with and cutting or otherwise injuring the grip hand is virtually eliminated.

Although the description above contains many specificities, these should not be construed as limiting the scope of the invention, but as merely providing illustrations of certain of the presently preferred embodiments of the invention. Various other embodiments and ramifications are possible within the scope thereof, for example, the grip member may be configured to engage a portion of the hand different from the metacarpal head area, such as at the knuckles or at the base of the hand, for example, and may therefore have a different (and in some embodiments possibly convex) contour from that described above. Furthermore, a draw lock mechanism may be incorporated to assist in targeting and alignment, a laser sighting system may be employed to assist in target acquisition, the grip, draw shelf guard, arrow rest and wire loop may be marketed as a package to upgrade a vertical bow to horizontal use, and so on. Thus, the scope of the present invention should be determined by the appended claims and their legal equivalents, rather than by the examples given above.

What is claimed is:

1. A bow assembly for being cast in a horizontal orientation, said bow assembly comprising:

a bow body having a riser, limbs and bowstring that define a primary plane of said assembly; and a grip member on said riser of said bow body, said grip member comprising a horizontally extending alignment channel for engaging a portion of a user's grip hand so as to define a generally horizontal pivot axis between said grip member and said hand;

said alignment channel being positioned so that said pivot axis is formed proximate and substantially parallel to said primary plane of said bow assembly, so as to minimize development of torque about said horizontal pivot axis as said bowstring is moved rearwardly towards a drawn position.

2. The bow assembly of claim 1, wherein said alignment channel in said grip member comprises:

a generally concave channel portion for receiving and engaging a ball portion of a user's grip hand.

3. The bow assembly of claim 2, wherein said generally concave channel portion comprises:

a horizontally elongate, generally concave channel portion for receiving a metacarpal head portion of a user's grip hand at the bases of a plurality of fingers of said hand.

4. The bow assembly of claim 2, wherein said channel portion comprises:

an enlarged, generally concave socket portion for receiving a metacarpal head area at the base of an index finger of a user's grip hand.

5. The bow assembly of claim 2, wherein said horizontally extending alignment channel is located proximate a rearward edge of said riser.

6. The bow assembly of claim 5, wherein said grip member further comprises:

a rearward surface having said alignment channel formed therein;

an upper surface contoured for engaging the fingers of a user's grip hand; and a lower surface contoured for engaging the thumb of a user's hand.

7. The bow assembly of claim 2, further comprising:

a thumb rest which extends downwardly below said grip member for engaging the thumb of a user's grip hand so as to stabilize said bow assembly as said bowstring is moved rearwardly towards a drawn position.

8. The bow assembly of claim 1, wherein said grip member is formed as a separate piece that is mounted to said riser.

9. The bow assembly of claim 1, wherein said grip member is formed integrally with said riser.

10. The bow assembly of claim 1, further comprising:

means for supporting an arrow rest in a horizontal orientation parallel to said primary plane of said assembly.

11. The bow assembly of claim 10, wherein said means for supporting said arrow rest comprises a bracket assembly mounted to said riser, said bracket assembly comprising a rearwardly extending attachment portion having said arrow rest mounted thereto.

12. The bow assembly of claim 11, wherein said bracket assembly further comprises:

an upwardly extending attachment portion having at least one sighting aid mounted thereto in a horizontal orientation above and parallel to said primary plane of said assembly.

13. The bow assembly of claim 11, wherein said bracket assembly further comprises;

a thumb rest portion extending downwardly from said riser for engaging a thumb of a user's grip hand so as to stabilize said assembly as said bowstring is moved rearwardly towards a drawn position.

14. An apparatus for mounting to a bow body so as to form a bow assembly for being cast in a horizontal orientation, said bow body having a riser, limbs and bowstring that define a primary plane of said assembly, said apparatus comprising:

a grip member which is mountable on said riser of said bow body, said grip member comprising a horizontally extending alignment channel for engaging a portion of a user's grip hand so as to define a generally horizontal pivot axis between said grip member and said hand;

said alignment channel being positioned so that when said grip member is mounted on said riser said pivot axis is formed proximate and substantially parallel to said primary plane of said bow assembly, so as to minimize development of torque about said horizontal pivot axis as said bowstring is moved rearwardly towards a drawn position.

15. The apparatus of claim 14, wherein said alignment channel in said grip member comprises:

a generally concave channel portion for receiving and engaging a ball portion of a user's grip hand.

16. The apparatus of claim 15 wherein said generally concave channel portion comprises:

a horizontally elongate, generally concave channel portion for receiving a metacarpal head portion of a user's grip hang at the bases of a plurality of fingers of said hand.

17. The apparatus of claim 15, wherein said horizontally extending alignment channel is located proximate a rearward edge of said riser when said grip member is mounted thereon.

18. The apparatus of claim 17 wherein said grip member further comprises:

a vertical web portion having said concave channel portion formed on a rearward surface thereof, and upper and lower vertically spaced flange portions which extend forwardly from said web portion;

said web portion and flange portions cooperating to define a U-shaped channel for receiving said rearward edge of said riser in close-fitting engagement therewith.

19. A method for casting a bow assembly in a generally horizontal orientation, said bow assembly including a bow body having a riser, limbs and bowstring that define a primary plane of said assembly, said method comprising the steps of:

providing a grip member on said riser, said grip member having a horizontally extending channel portion formed therein; and engaging said horizontally extending channel portion with a portion of a user's grip hand so as to define a generally horizontal pivot axis between said grip member and said hand;

said alignment channel being positioned so that said pivot axis is formed proximate and substantially parallel to said primary plane of said bow assembly, so as to minimize development of torque about said horizontal pivot axis as said bowstring is moved rearwardly towards a drawn position.

20. The method of claim 19, wherein the step of engaging said horizontally extending channel position with a portion of said user's grip hand comprises:

engaging a generally concave portion of said channel portion with a ball portion of a said user's grip hand.

21. The method of claim 20 further comprising the steps of moving said bowstring rearwardly to a drawn position with an arrow in a nock position on said bow assembly; and pivoting said bow assembly about said horizontal axis which is defined by said grip member and said ball portion of said grip hand so as to aim said arrow in said nock position, by moving said bow alternately in upward and downward directions with said bowstring in said drawn position.

* * * * *